United States Patent [19]

Barnstead

[11] 4,187,055

[45] Feb. 5, 1980

[54] FLEXIBLE FAN

[75] Inventor: John W. Barnstead, Kokomo, Ind.

[73] Assignee: Vernco Corporation, Columbus, Ind.

[21] Appl. No.: 892,658

[22] Filed: Apr. 3, 1978

[51] Int. Cl.[2] ..... F04D 29/38

[52] U.S. Cl. ..... 416/132 A; 416/240

[58] Field of Search ..... 416/132 R, 132 A, 241 A, 416/240, DIG. 3

[56] References Cited

U.S. PATENT DOCUMENTS

| | | | |
|---|---|---|---|
| D. 193,643 | 9/1962 | Klonoski et al. | 416/132 A X |
| 2,132,133 | 10/1938 | Smith | 416/132 A |
| 3,289,924 | 12/1966 | Weir | 416/132 A |
| 3,758,231 | 9/1973 | Barnstead | 416/241 A X |
| 3,836,284 | 9/1974 | DeJong | 416/132 A |
| 3,860,362 | 1/1975 | Bentley et al. | 416/132 A |

FOREIGN PATENT DOCUMENTS

| | | | |
|---|---|---|---|
| 411904 | 6/1910 | France | 416/132 A |
| 1272645 | 5/1972 | United Kingdom | 416/132 A |
| 1319193 | 6/1973 | United Kingdom | 416/132 A |

*Primary Examiner*—Everette A. Powell, Jr.

*Attorney, Agent, or Firm*—Gust, Irish, Jeffers & Rickert

[57] ABSTRACT

A flexible fan which automatically reduces its pitch in response to increased rotation speed includes a hub having an axis of rotation and a plurality of blades extending radially outwardly therefrom. Each blade has a leading surface, a root portion joined to the hub, a tip portion, leading and trailing edges, and a relatively stiff leading portion joined to a relatively flexible trailing portion by a relatively narrow hinge zone which extends diagonally across the blade from generally the trailing edge of the root portion to generally the leading edge of the tip portion. A pair of stiffening ribs are provided on the leading surface of the leading blade portion which define a triangle with its base joining the hub and its apex extending toward the tip portion, one rib being adjacent and generally parallel with the hinge zone, and the other rib being spaced from and generally parallel with the leading edge. The trailing edge of each blade includes a first portion which extends outwardly from the hub and a second portion joined to the first portion and extending to the tip portion and defining angles with the first portion and the tip portion, and with the junction of the first and second trailing edge portions lying on a line which extends radially from the axis when the blade is in its high speed, reduced-pitch condition, all portions of the blade lying substantially forward of that line in the direction of the leading edge.

17 Claims, 10 Drawing Figures

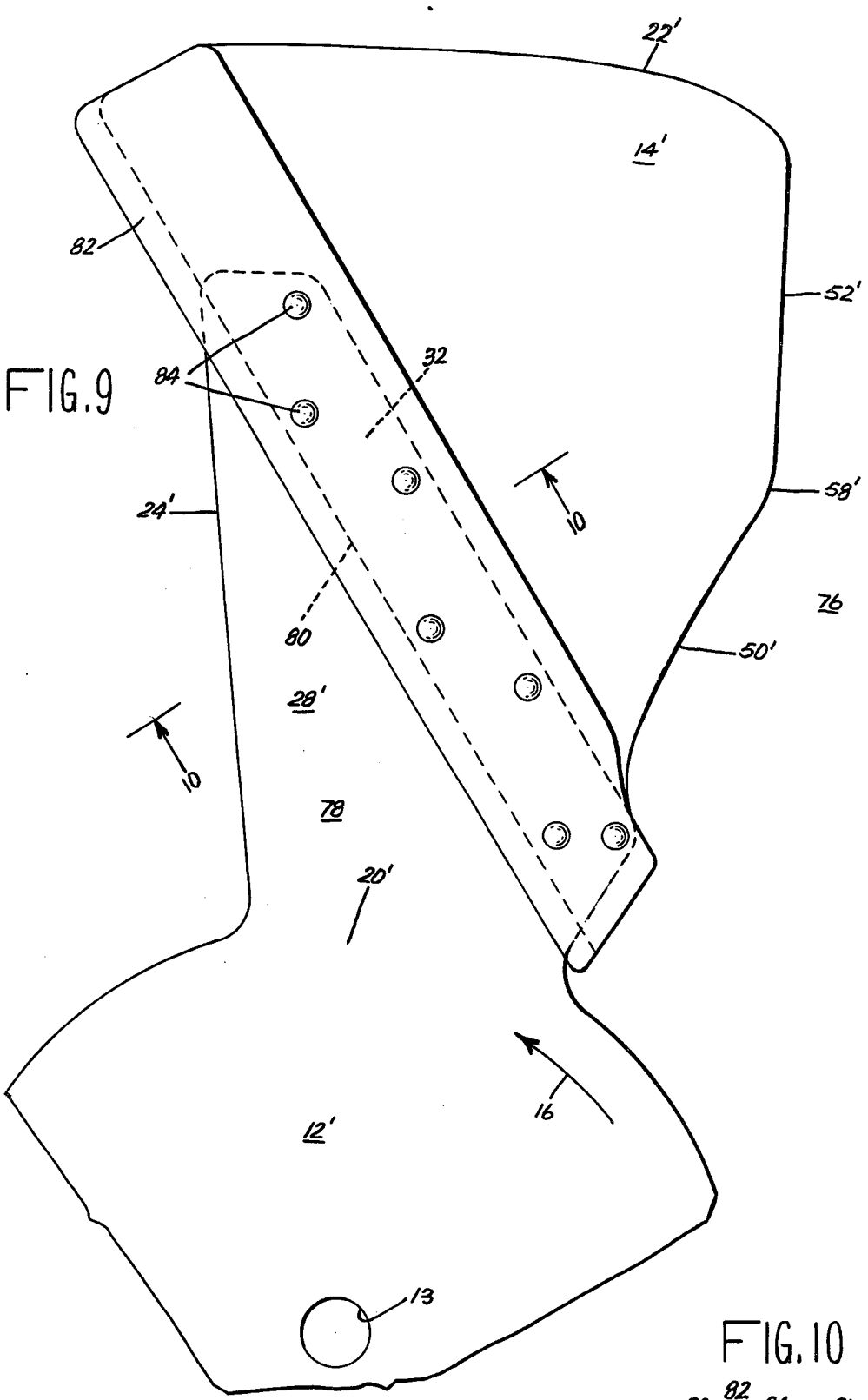
FIG. 9
FIG. 10
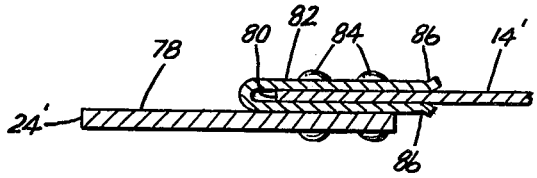

FLEXIBLE FAN

BACKGROUND OF THE INVENTION

1. Field of the Invention

This invention relates generally to flexible fans which automatically reduce pitch in response to increased rotational speed.

2. Description of the Prior Art

In water-cooled internal combustion engine-powered automotive vehicles, the engine-driven fan must draw a large volume of cooling air through the radiator when the vehicle is stationary or operating at low speed whereas, at high vehicle speeds, the movement of the vehicle itself produces much of the required cooling airflow through the radiator and thus, the demand for air movement by the fan is significantly decreased. In fact, in certan larger air conditioned automobiles, a fan clutch is provided to disable the fan at high engine speeds in order to prevent excessive cooling.

U.S. Pat. No. 3,758,231 to the present applicant and assigned to the assignee of the present application describes and illustrates a molded plastic flexible fan which automatically reduces its pitch in response to increased rotational speed. That fan includes a plurality of blades radiating from a hub, each blade having a root portion joined to the hub, a tip portion, leading and trailing edges, a relatively stiff leading portion and a relatively flexible trailing portion joined to the leading portion by a relatively narrow intermediate or hinge zone which extends diagonally across the blade from generally the trailing edge of the root portion to generally the leading edge of the tip portion.

The felxible fan shown and described in the aforesaid patent was never produced as a one-piece, molded unit, the cost of a mold being too high by reason of the overlap between the leading and trailing edges of certain adjacent blades at the root thereof which required a side-pull on the mold.

In an effort to solve the mold cost problem, I provided a notch in the trailing edge of each blade at the root so as to eliminate the overlap of certain blades. However, when that fan was molded as a one-piece unit, it was found that a failure mode was encountered in high speed cycle tests, i.e., repeated cycling from zero to a high speed such as 6750 rpm. Such failure is in the nature of a fracture which starts at the trailing edge of a blade in the hinge zone and progresses outwardly in the hinge zone until slightly past the mid point therealong, at which point the fracture turns toward the trailing edge in some cases and toward the leading edge tip point in others.

SUMMARY OF THE INVENTION

I have found that the above-described failure is due to flutter caused by the mechanical and aerodynamic coupling of two bending modes which are generally at right angles to each other, these modes being affected by rotational centrifugal forces in differing manners.

The first mode of vibration is a bending about the hinge zone and is angular velocity-dependent with the frequency of the vibration increasing roughly as the square of the angular velocity becoming asymptotic to an increase twice the rotational speed. The second mode of vibration is a bending about a line generally perpendicular to the hinge zone at a point slightly beyond the mid point thereof and is either independent of rotational speed or increases only at approximately the square root of the speed.

These bending vibrations are mechanical oscillations, the shaped blade being the mechanical system with the mass and spring constants being equivalent to the blade stiffness and being distributed therealong. At each point along the blade, the rotational centrifugal force can be resolved into a component which tends to stiffen the first mode of vibration and another component which modifies the second mode. Further, before failure takes place, stall flutter occurs, analogous to the stall of an aircraft wing, in which the boundry layer of air separates from the airfoil resulting in blade stall which allows the blade to assume a steeper angle of attack with the resultant over-excursion producing the stall flutter.

The characteristic curves of the first and second modes of vibration, i.e., the resonant frequency versus the rotational speed, intersect at a particular speed which, in the case of the flexible plastic fan blades in accordance with my prior patent, is close to the high speed of the cycle test.

I have found that the failure previously encounted can be eliminated by preventing frequency correspondence of the first and second vibration modes. This has been accomplished by eliminating the bracing rib of the prior blade which extended from the hub to the leading edge, stiffening the point of attachment of the flexible trailing portion of the blade to the hinge zone, and reproportioning the trailing edge so that all portions of the blade lie substantially forwardly of a radial line extending from the center of the hub to the trailing edge joint of the blade to the hub. These modifications reduce the mass moment of inertia about the axis of the second mode of vibration increasing the initial value of its resonant frequency and also cause the resonant frequency of the second mode of vibration to increase more lineraly with the rotational speed so that the intersection of the characteristic curves of the two modes of vibration is moved to a rotational speed above any encountered in the cycle tests or any normal operation of the fan. These modifications do not disturb the first mode of flexing required by the function of the flexible fan while eliminating the failures previously encountered.

The invention, in its broader aspects, provides a flexible fan which automatically reduces its pitch in response to increased rotational speed and which comprises a hub having an axis of rotation and a plurality of blades extending radially outward therefrom. Each blade has a leading surface, a root portion joined to the hub, a tip portion, leading and trailing edges, and a relatively stiff leading portion joined to a relatively flexible trailing portion by a relatively narrow hinge zone which extends diagonally across the blade from generally the trailing edge of the root portion to generally the leading edge of the tip portion, the leading portion being defined by the hinge zone, root portion and leading edge, and the trailing portion being defined by the hinge zone, tip portion and trailing edge. The pitch of each blade at rest is substantially greater at the tip portion than at the root portion. A stiffening portion is provided on the leading surface of the leading blade portion extending outwardly from the root portion adjacent and generally parallel with the hinge zone for stiffening the attachment of the trailing portion with the hinge zone.

In the preferred embodiment of the invention, the stiffening portion is generally triangularly shaped with its base joining the hub, one side adjacent and generally parallel with the hinge zone. Further, in the preferred embodiment, the trailing edge of each blade includes a first portion which extends outwardly from the hub and a second portion joined to the first portion and extending to the tip portion and defining angles with the first portion and tip portion, the junction of the first and second trailing edge portions lying on a line extending radially from the axis of the blade when the blade is in its reduced-pitch condition, all portions of the blade lying substantially forwardly of that line in the direction of the leading edge.

It is accordingly an object of the invention to provide an improved flexible fan which automatically reduces its pitch in response to increased rotational speed.

Another object of the invention is to provide an improved flexible fan which automatically reduces its pitch in response to increased rotational speed and in which failures encountered in prior flexible fans are substantially eliminated.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 9 is a top view of one blade of a flexible metal fan incorporating the invention; and FIG. 10 is a fragmentary cross-sectional view taken generally along the line 10—10 of FIG. 9.

DESCRIPTION OF THE PREFERRED EMBODIMENT

Figure 1:
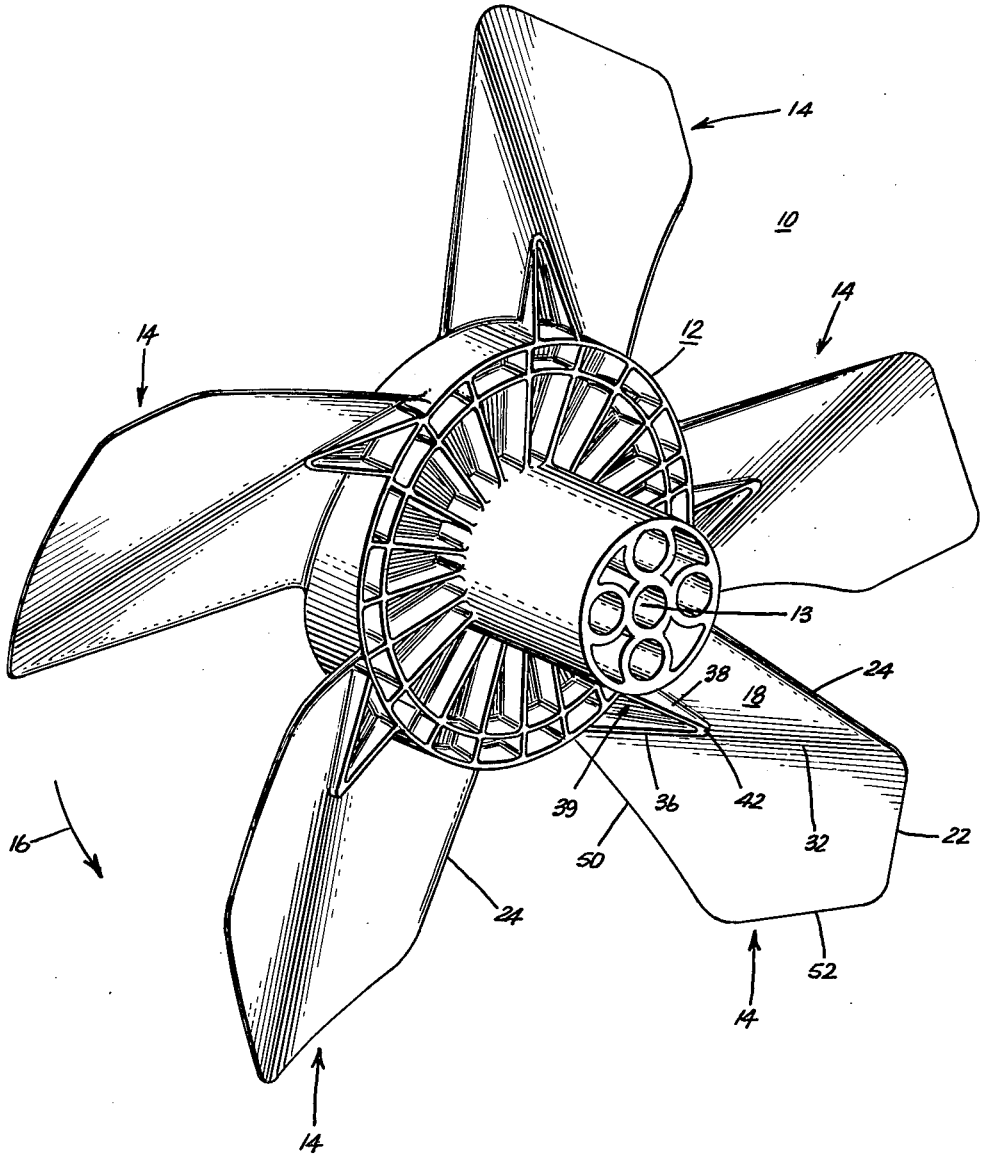
FIG. 1 is a perspective view showing a molded plastic flexible fan incorporating the invention.

Referring now to FIGS. 1 through 7 of the drawings, the improved flexible fan of the invention, generally indicated at 10, is preferably integrally molded of suitable plastic material, such as glass-filled nylon, and includes hub 12 having axis of rotation 13 with a plurality of blades 14 extending radially outwardly therefrom. Blades 14 are substantially identical and in the illustrated embodiment, are assymetrically peripherally spaced around the hub for the purpose of noise reduction at high speed, as more fully described in my aforesaid U.S. Pat. No. 3,758,231; however, it is seen that no two blades overlap. Blade 10 is intended to rotate in the direction shown by arrow 16.

Figure 6:
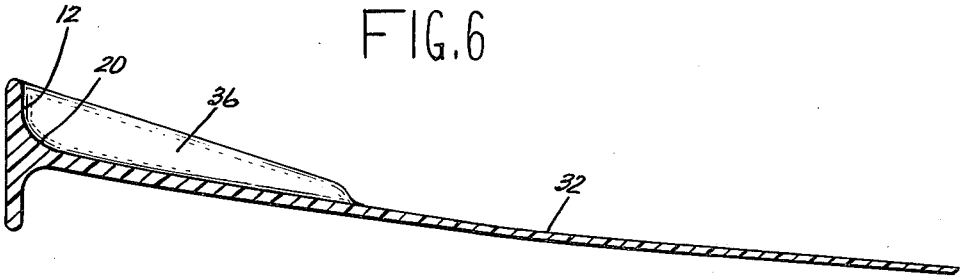
FIG. 6 is a fragmentary cross-sectional view taken generally along the line 6—6 of FIG. 2.
Figure 7:
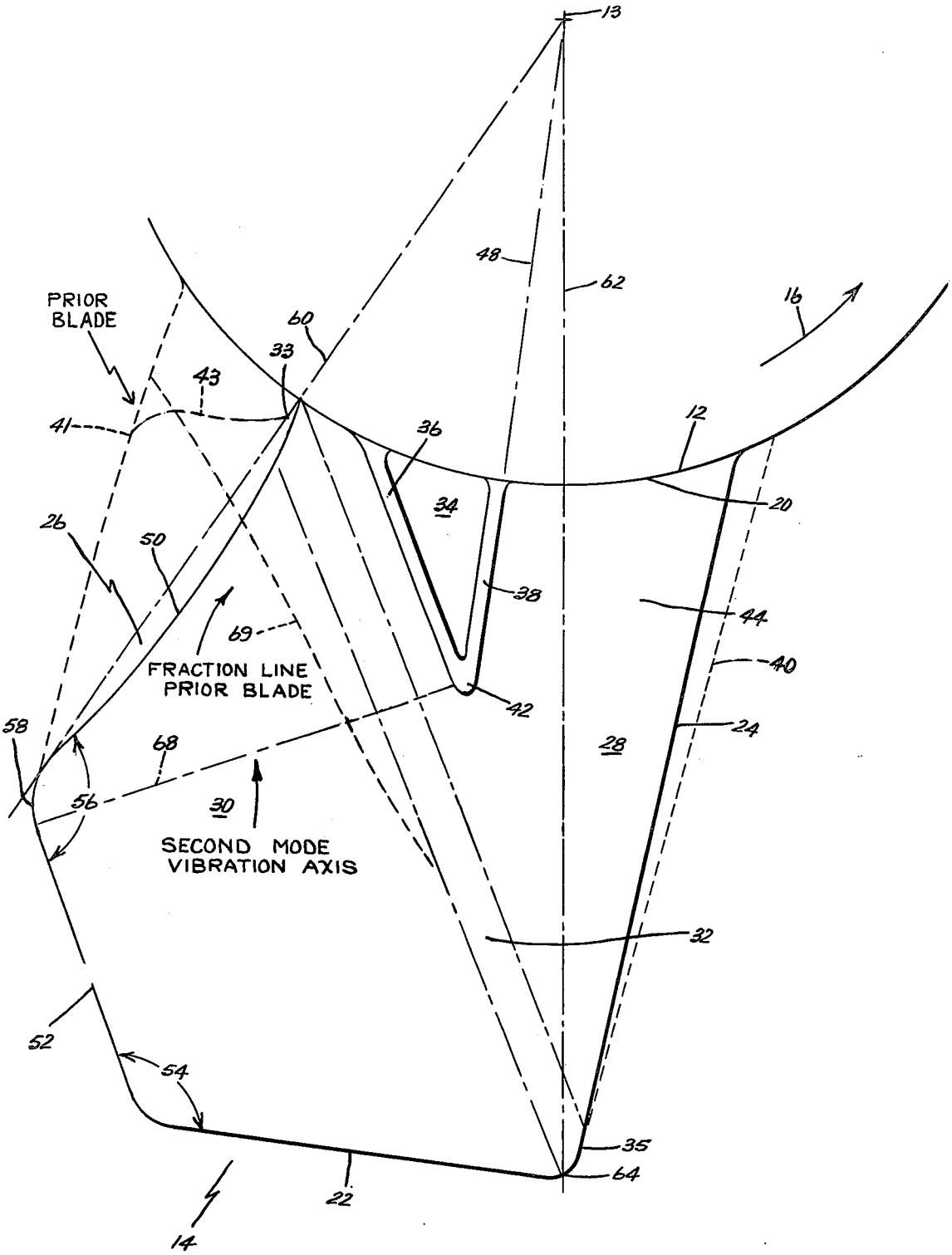
FIG. 7 is a top view of one blade shown in its high speed, low pitch condition and showing a comparison with the blade of the prior flexible fan.

Each blade 14 has leading surface 18, root portion 20 joined to hub 12, tip portion 22, and leading and trailing edges 24, 26. Each blade 14 has relatively stiff leading portion 28 joined to relatively flexible trailing portion 30 by relatively narrow intermediate or hinge zone 32 which extends from trailing edge 33 of root portion 20 diagonally across the blade to leading edge 35 adjacent tip portion 22 (FIG. 7). As best seen in FIG. 6, in the at-rest condition of fan 10, tip portion 22 of each blade 14 has a substantially greater pitch than that of root portion 20. It will be readily understood that as the rotational speed of fan 10 increases, centrifugal force and aerodynamic lift will cause flexible portion 30 of each blade 14 to tend to flatten from hinge zone 32 thereby to decrease the pitch.

Figure 2:
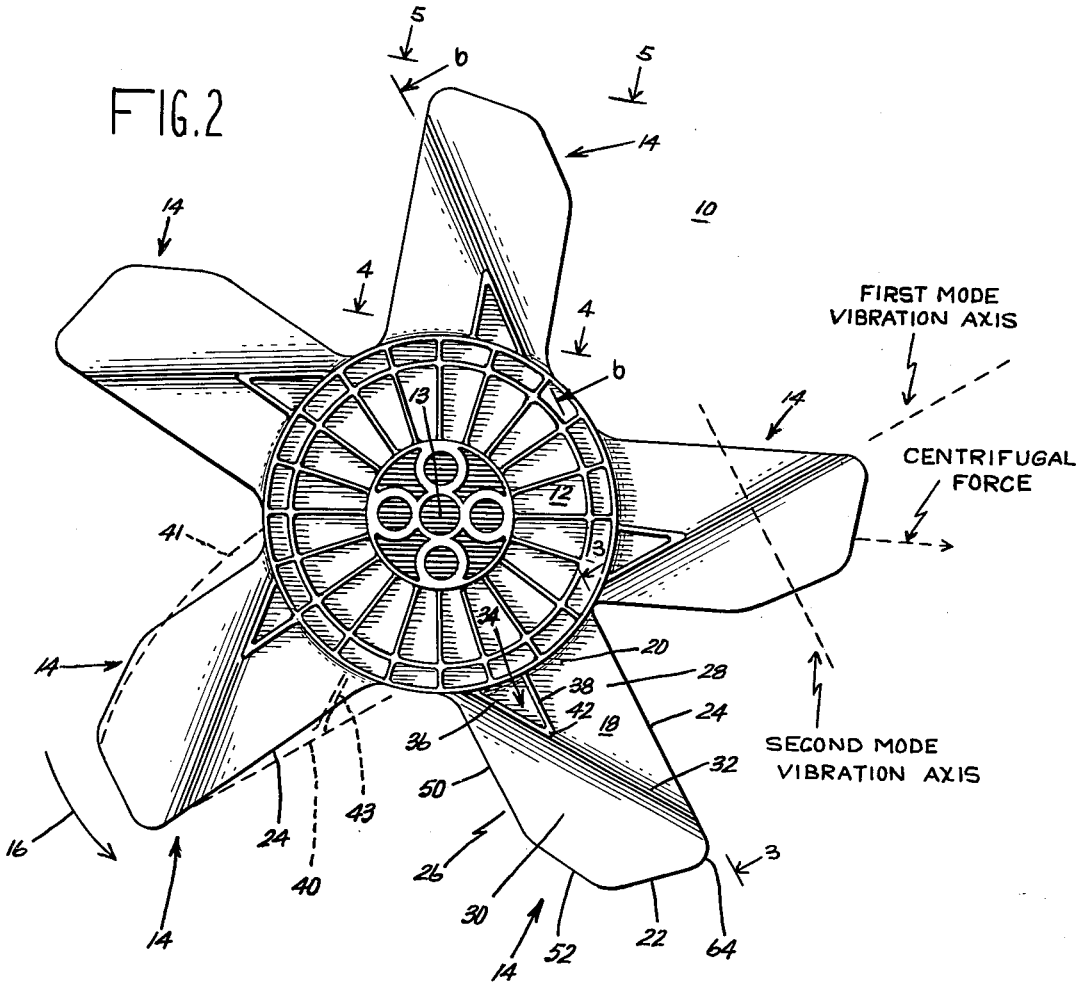
FIG. 2 is a top view of the fan of FIG. 1 shown in its at-rest condition.
Figure 3:
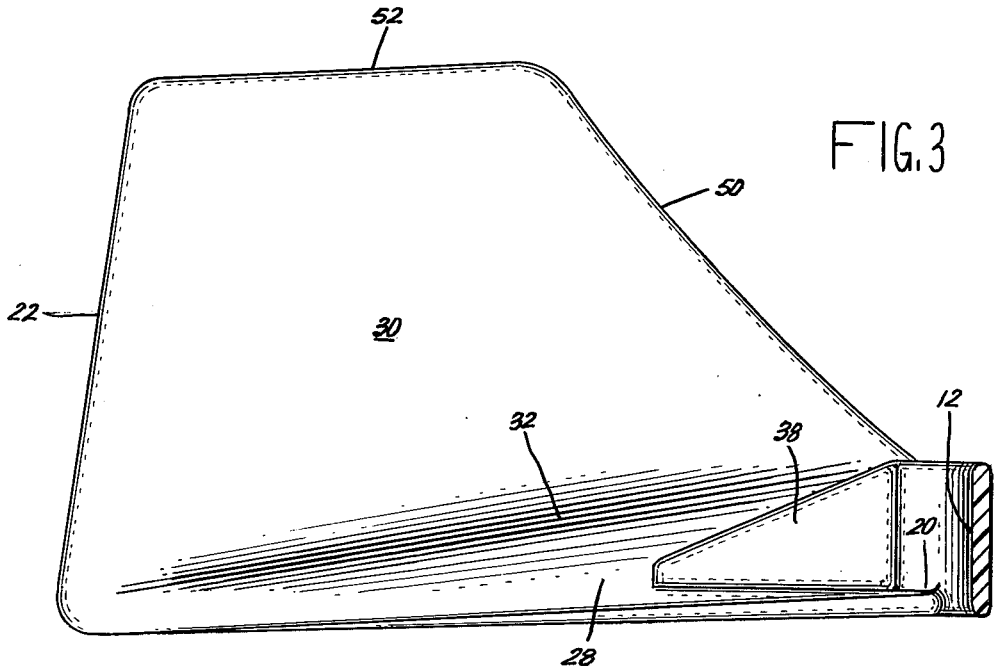
FIG. 3 is a front view of one blade of the improved flexible fan of the invention shown in its at-rest condition.
Figure 4:
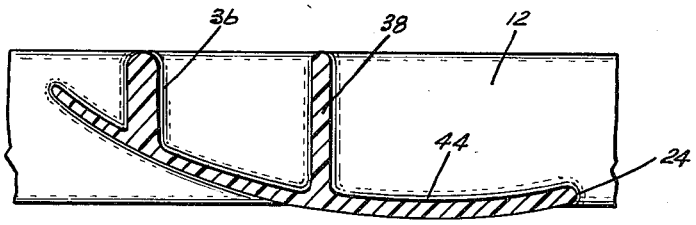
FIG. 4 is a fragmentary cross-sectional view taken generally along the line 4—4 of FIG. 2.
Figure 5:
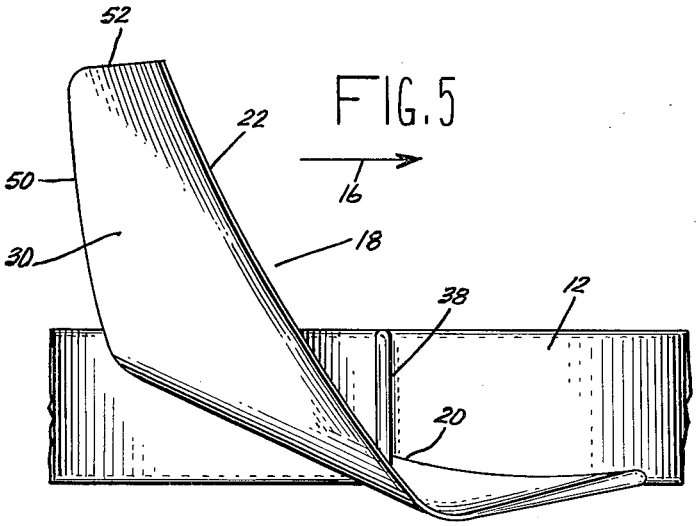
FIG. 5 is an end view of one blade in its at-rest condition viewed generally along the line 5—5 of FIG. 2.

In accordance with the invention, stiffening portion 34 is provided on leading surface 18 of each blade 14 comprising ribs 36, 38 arranged in a triangle with its base joined to hub 12 and its apex 42 extending outwardly toward tip portion 22. Rib 36 is adjacent and generally parallel with hinge zone 32, and rib 38 in the illustrated embodiment is spaced from and generally parallel with leading edge 24 and lies generally on radial line 48 extending from axis 13. Bracing rib 43 of the prior fan, shown in dashed lines in FIG. 2, is eliminated so that area 44 of leading surface 18 between rib 38 and leading edge 24 is substantially smooth, as shown in FIG. 4. In the illustrated embodiment, the length of stiffening portion 34 from hub 12 to apex 42 is approximately one-third ($\frac{1}{3}$) the length of hinge zone 32.

Referring now particularly to FIG. 7, trailing edge 26 of each blade 14 has first portion 50 extending outwardly from hub 12 and second portion 52 extending from first portion 52 to tip portion 22. Trailing edge portion 52 defines obtuse angle 54 with tip portion 22 and obtuse angle 56 with trailing edge portion 50. In accordance with the invention, when blade 14 is in its high speed, flattened, low pitch condition, intersection 58 of trailing edge portions 50, 52 lies on line 60 extending radially from axis 13 and all portions of blade 14 lie forwardly of line 60 in the direction of leading edge 24. Further, trailing edge portion 50 lies close to radial line 60, as shown in FIG. 7. This is in contrast with the blade shown in my aforesaid patent in which trailing edge 41 extended rearwardly of radial line 60 in dashed lines in FIG. 7. The notch removed from the trailing edge is an effort to reduce the mold cost is shown in dashed lines at 43.

Line 62 extending radially from axis 13 of blade 14 extends through leading tip 64 of tip portion 22. In the illustrated embodiment, the angle defined by leading edge 24 with line 62 is somewhat smaller than that defined by leading edge 40 of the prior blade, as shown in dashed lines in FIG. 7. The axis of the second mode of vibration of blade 14 is shown in dashed lines at 68 in FIG. 7 and the fracture line of the prior blade is shown in dashed lines at 69.

Figure 8:
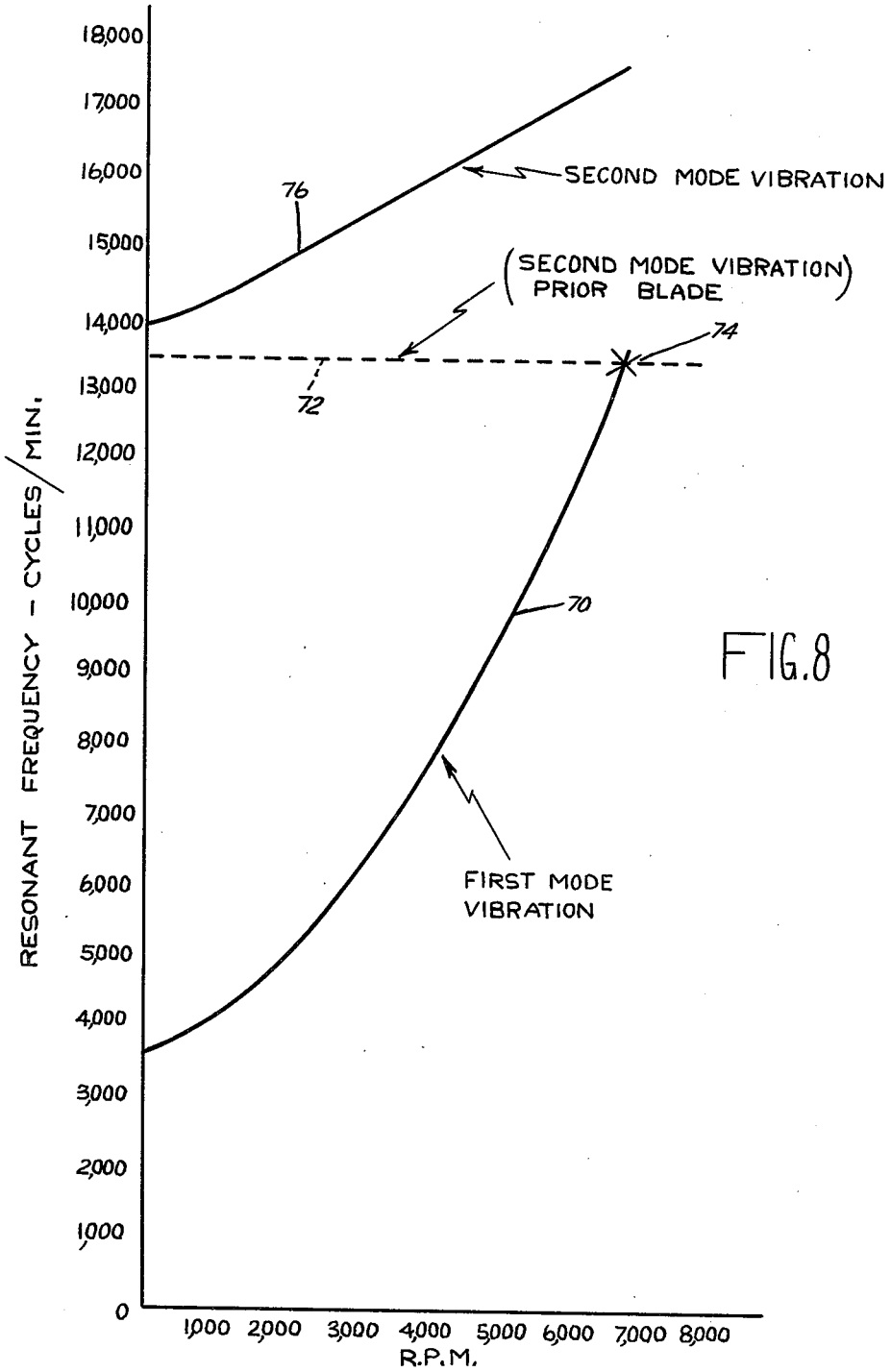
FIG. 8 shows the characteristic curves of the first and second mode vibrations of the improved fan of the invention compared with the prior flexible fan.

Referring now to FIG. 8 in which the resonant frequency in cycles per minute of the first and second mode vibrations is plotted against rotational speed in rpm, the characteristic curve of the first mode vibration in both the prior and present blade is shown at 70 and the characteristic curve of the second mode vibration of the prior blade is shown in dashed lines at 72, the intersection of the first and second mode vibrations being shown at 74. With the improved blade construction described above, the second mode vibration is forced to a higher dependence on the rotational velocity, as shown by the characteristic curve 76. It will readily be seen that in accordance with the invention, intersection point 74 of the first and second mode vibrations of the prior blade is eliminated and the first and second mode vibration characteristic curves 70, 76 do not intersect at the high speed of a cycle test, i.e., 6750 rpm. It has been found that the improved molded plastic flexible fan blade of the invention will withstand 60,000 test cycles of zero (0) to 6,750 rpm whereas, the prior flexible fan will withstand only about 6,000 cycles.

Referring now to FIGS. 9 and 10 in which like elements are indicated by like reference numerals and similar elements by primed reference numerals, the invention is also applicable to a metal flexible fan, generally indicated at 76, having hub portion 12' with relatively stiff spider portions 78 integrally formed therewith and extending radially outwardly therefrom; spider portions 78 have leading edges 24'. Relatively flexible metal blades 14' are attached to spider portions 78 by folded, U-shaped intermediate strips 82 and rivets 84, strips 82 embracing forward edges 80 of blades 14'. It will be seen that strips 82 provide stiffening for blades 14' extending outwardly from the root portion 20' generally parallel with hinge zone 32' of blades 14'. Trailing edges 86 of strips 82 are preferably formed upwardly as seen in FIG. 10, so that blades 14' do not hit sharp edges when they flex.

It is important in both embodiments of the invention to insure that the blade is maintained in tension at all rotational speeds within the practical range of operation since if any portion of the blade is permitted to go into compression, the frequency of the second mode vibration is reduced.

While there have been described above the principles of this invention in connection with specific apparatus, it is to be clearly understood that this description is made only by way of example and not as a limitation to the scope of the invention.

What is claimed is:

1. In a flexible fan which automatically reduces its pitch in response to increased rotational speed and comprises a hub having an axis of rotation and a plurality of blades extending radially outwardly therefrom; each blade having a leading surface, a root portion joined to said hub, a tip portion, leading and trailing edges, and a relatively stiff leading portion joined to a relatively flexible trailing portion by a relatively narrow hinge zone which extends diagonally across the blade from generally the trailing edge of said root portion to generally the leading edge of said tip portion, said leading portion being defined by said hinge zone, root portion and leading edge and said trailing portion being defined by said hinge zone, tip portion and trailing edge, the pitch of each blade at rest being substantially greater at said tip portion than at said root portion thereof; each blade having a mode of vibration about said hinge zone the frequency of which increases as the rotational speed of the fan increases, and a second mode of vibration about a line generally perpendicular to said hinge zone; the improvement comprising a stiffening portion on said leading surface of said leading blade portion of each blade extending outwardly from said root portion adjacent and generally parallel with said hinge zone for stiffening the junction of said trailing portion with said hinge zone and all portions of each blade lying substantially forwardly in the direction toward said leading edge of a radial line extending from said axis of rotation through the junction of said trailing edge and said hub whereby the frequency of said second mode vibration is higher than and does not approach the frequency of said first mode vibration as said rotational speed is increased.

2. The fan of claim 1 wherein said stiffening portion is generally triangularly-shaped with its base joining said hub, one side adjacent and generally parallel with said hinge zone, and its apex facing said tip portion.

3. The fan of claim 2 wherein the other side of said stiffening portion is spaced from said leading edge, the area of said leading surface between said other side and said leading edge being substantially smooth.

4. The fan of claim 2 wherein the other side of said stiffening portion is generally parallel with said leading edge.

5. The fan of claim 2 wherein said stiffening portion comprises a pair of ribs which define said triangular shape.

6. The fan of claim 5 wherein the rib defining the other side of said stiffening portion is spaced from and generally parallel with said leading edge, the area of said leading surface between said last-named rib and said leading edge being substantially smooth.

7. The fan of claim 6 wherein the length of said stiffening portion from said hub to said apex thereof is approximately one-third the length of said hinge zone.

8. The fan of claim 7 wherein said last-named rib extends generally radially with respect to said axis.

9. The fan of claim 8 integrally formed of molded plastic material.

10. The fan of claim 1 wherein each said blade is formed of metal, said stiffening portion comprising a stiffening member secured to said blade.

11. The fan of claim 10 wherein said hub portion is formed of metal and has spider portions extending radially outwardly therefrom, said spider portions respectively forming said leading portions, and further comprising means including said stiffening member for securing each said blade to a respective spider portion.

12. The fan of claim 11 wherein each said blade has a forward edge adjacent and parallel with said hinge zone, each said stiffening member being elongated and having spaced side edges parallel with the respective forward edge.

13. The fan of claim 12 wherein each said stiffening member is U-shaped and embraces said forward edge of the respective blade, each said stiffening member having upwardly formed trailing edges, said securing means further including fastening means extending through said stiffening members and the respective blades.

14. The fan of claim 1 wherein said trailing edge includes a first portion extending outwardly from said hub and a second portion joined to said first portion and extending to said tip portion and defining angles with said first portion and tip portion, the junction of said first and second trailing edge portion lying on a line extending radially from said axis when said blade is in its reduced-pitch condition.

15. The blade of claim 14 wherein said first trailing edge portion lies generally on said line.

16. The blade of claim 14 wherein said stiffening portion comprises a pair of ribs which define a generally triangular shape with the base thereof joining said hub, one leg generally parallel with said hinge zone, the other leg spaced from said leading edge, and the apex facing said tip portion, the area of said leading surface between said other leg and said leading edge being substantially smooth.

17. The blade of claim 16 wherein said other leg is generally parallel with said leading edge and extends generally radially with respect to said axis, the length of said stiffening portion from said hub to the apex thereof being approximately one-third the length of said hinge zone, said fan being integrally formed of molded plastic material.

* * * * *